US005551130A

United States Patent [19]

Tominaga et al.

[11] Patent Number: 5,551,130

[45] Date of Patent: Sep. 3, 1996

[54] HOOK STRUCTURE OF MOLDED SURFACE FASTENER

[75] Inventors: Yutaka Tominaga; Hiroshi Yoshida, both of Toyama, Japan

[73] Assignee: YKK Corporation, Tokyo, Japan

[21] Appl. No.: 583,535

[22] Filed: Jan. 5, 1996

Related U.S. Application Data

[63] Continuation of Ser. No. 298,170, Aug. 30, 1994, abandoned.

[30] Foreign Application Priority Data

Sep. 14, 1993 [JP] Japan ..... 5-229148

[51] Int. Cl.[6] ..... A44B 18/00

[52] U.S. Cl. ..... 24/452; 24/442; 24/449

[58] Field of Search ..... 24/306, 442, 452, 24/575–577

[56] References Cited

U.S. PATENT DOCUMENTS

| | | | |
|---|---|---|---|
| 3,557,413 | 1/1971 | Engle . | |
| 4,001,366 | 1/1977 | Brumlik . | |
| 4,984,339 | 1/1991 | Provost et al. | 24/442 X |
| 5,116,563 | 5/1992 | Thomas et al. | 24/442 X |
| 5,131,119 | 7/1992 | Murasaki et al. | 24/442 X |
| 5,339,499 | 8/1994 | Kennedy et al. | 24/442 X |
| 5,361,462 | 11/1994 | Murasaki | 24/452 |

*Primary Examiner*—Peter M. Cuomo
*Assistant Examiner*—Robert J. Sandy
*Attorney, Agent, or Firm*—Hill, Steadman & Simpson

[57] ABSTRACT

In a hook structure for a molded surface fastener, each of hooks is composed of a rising portion, which has a rear surface rising obliquely in a smooth curve from the substrate, a front surface rising upwardly from the substrate, and side surfaces from at least one of which a reinforcing rib extends, and a hook-shape engaging portion extending forwardly from an upper end of the rising portion. The engaging portion has a varying cross-sectional area increasing progressively from its distal end toward the upper end of the rising portion. A straight line between a peak of the rib and a peak of an arcuate lower surface of the engaging portion is substantially parallel to the upper surface of the substrate. The rib is rising upwardly and substantially centrally from a side surface of base of each hook. A straight line passing a center point in height of the rib and parallel to the surface of the substrate crosses a ridge of the rib and a ridge of the rising portion of each hook in such a manner that the ratio of a line segment of the straight line between the crossing points with the ridge of the rib to a line segment of the straight line between crossing points with the ridge of the rising portion is ⅕ to ½.

7 Claims, 6 Drawing Sheets

HOOK STRUCTURE OF MOLDED SURFACE FASTENER

This is a continuation, of application Ser. No. 08/298,170, filed Aug. 30, 1994 now abandoned.

BACKGROUND OF THE INVENTION

1. Field of the Invention

This invention relates to an engaging member, for a surface fastener, in which a plate-like substrate and a multiplicity of hooks are molded of thermoplastic resin by extrusion or injection molding, and more particularly to a hook structure which has both flexibility and toughness like a monofilament though molded and is very durable.

2. Description of the Related Art

A hooked surface fastener has been known long since in which hooks are formed by cutting loops of monofilaments woven into a woven cloth. With this type of surface fastener, flexibility of the woven cloth and flexibility of the monofilaments combine to make a very smooth touch when the hooks come into and out of engagement with loops of the companion fastener member. Additionally, since the monofilaments forming hooks are treated with drawing process, they are excellent in toughness against pulling and bending though small in cross-sectional area. Further, since the hooks can be formed in high density depending on the structure of the woven cloth, this type of surface fastener has a high engaging rate and hence can survive in repeated use. However, with this woven-cloth-type surface fastener, since the hooks tend to deform as they give a very smooth touch during engaging and peeling, there is a limit in engaging strength. Further, partly since the quantity of material is large and partly since a large number of process steps are required, it is difficult to reduce the cost of production.

To this end, an alternative molded surface fastener has been developed in which the substrate and the hooks are simultaneously and integrally molded by extrusion molding. The molding technology for this type surface fastener is disclosed in, for example, U.S. Pat. No. 3,312,583 and WO 87/06522. In this molding method, a number of mold discs, each of which has a number of hook-forming cavities in its peripheral side surfaces, and a number of spacer discs, each of which has opposite flat side surfaces, are fixedly arranged alternately in a laminate drum. Hooks, which have been molded in cavities in the peripheral surface of the rotating drum integrally with a plate-like substrate, are removed, together with the substrate, from the peripheral surface of the drum. The reason why the spacer discs must be used in the prior art is that the whole contour of the individual hooks could not have been made in a single mold.

However, with the prior art integrally molded surface fastener, because of technological difficulty in molding process, it is impossible to obtain a delicate shape like the woven cloth type. Since the orientation of molecules of the molded hooks is poor, the degree of toughness of the hooks is very low if the hooks have the same size as those of monofilaments, thus making the surface fastener not suitable for practical use. Further, in the hook structure, the cross-sectional shape of its rising portion is simple so that the hook tend to fall flat from the base of the rising portion. As a result, the hooks would not restore its original posture after repeated use so that its engaging rate with loops of the companion fastener member would be lowered. Consequently, the size of the individual hooks must be increased in order to secure a desired degree of toughness. And the number of hooks per unit area (hook density) would be reduced so that the engaging rate of the hooks with companion loops will be lowered.

In order to eliminate the foregoing problems, an alternative hook structure which enables a smooth touch like the woven-type surface fastener, a high engaging rate and secures adequate toughness and durability in repeated use has been proposed by, for example, Japanese Utility Model Laid-Open Publication No. HEI 4-31512 (U.S. Pat. No. 5,131,119). In the molded surface fastener, each hook comprises a rising portion, which has a rear surface rising obliquely in a smooth curve from the substrate and a front surface rising upwardly, and a hook-shape engaging portion extending forwardly from the upper end of the rising portion. And the hook has a varying cross-sectional area increasing progressively from the distal end of the hook-shape engaging portion toward the base of the rising portion. Further, the rising portion has reinforcing ribs projecting from its respective side surfaces. This reinforcing ribs serve to keep the rising portion free from falling flat and also enable the rising portion and the hook-shape engaging portion to be reduced to minimum thicknesses which are enough to survive against a stress due to a required engaging strength.

The present inventors made a further study on the reinforcing ribs and found that the shape and arrangement of the reinforcing ribs gave a considerable influence on the distribution of stress of the hooks when the surface fastener is peeled. Thus as the shape and arrangement of the reinforcing ribs are changed, the distribution of their internal stress also will vary so that stresses tend to concentrate locally in the hook due to the compression and expansion.

The majority of conventional hooks which have been put into practice since the present inventors developed it has a structure shown in FIG. 5(*b*) of the accompanying drawings. As shown in FIG. 5(*b*), the hook 10' is composed of a rising portion 11' which has a rear surface 11*a*' rising obliquely in a smooth curve from the surface of a plate-like substrate 14' and a front surface 11*b*' rising upwardly, and a hook-shape engaging portion 12' extending forwardly from the upper end of the rising portion 11' and curving downwardly. The hook 10' has a varying cross-sectional area increasing progressively from the distal end of the hook-shape engaging portion 12' toward the base of the rising portion 11'. The rising portion 11' has on each of opposite side surfaces a reinforcing rib 13' having an arcuate upper surface and front and rear surfaces outwardly curving toward the base. The reinforcing rib 13' has a height about ⅔ of a vertical line segment between the surface of the plate-like substrate 14' and a peak $O_1$' of the lower surface of the hook-shape engaging portion 12' with the distal end curving downwardly. The reinforcing rib is located in a position toward the front surface of the hook 10'.

However, in the case where the shape and arrangement of the reinforcing ribs are as mentioned above, a large stress concentration due to the expansion and compression would occur at the hook side and rear-surface side of the hook-shape engaging portion 12' above the peak of the reinforcing rib 13', as shown in FIG. 5(A). Accordingly, when load is exerted repeatedly on the hook-shape engaging portion 12', the hook-shape engaging portion 12' will become fragile around the peak of the reinforcing rib 13'.

SUMMARY OF THE INVENTION

With the foregoing problems in view, it is an object of this invention to provide a hook structure which prevents hooks from falling flat, secures adequate toughness and flexibility and is durable against repeated use.

In order to solve the foregoing problems, according to this invention, a hook structure for a molded surface fastener having a multiplicity of hooks molded integrally on an upper surface of a plate-like substrate is characterized in that each of the hooks has a rising portion and a hook-shape engaging portion extending forwardly from an upper end of the rising portion. The rising portion has a rear surface rising obliquely in a smooth curve from the substrate, a front surface rising upwardly from the substrate, and side surfaces from at least one of which a reinforcing rib extends, the hook-shape engaging portion having a varying cross-sectional area increasing progressively from its distal end toward the upper end of the rising portion, and that a straight line between a peak of the reinforcing rib and a peak of an arcuate lower surface of the hook-shape engaging portion is substantially parallel to the upper surface of the plate-like substrate.

Further, the reinforcing rib is rising upwardly and substantially centrally from aside surface of the base of each hook. And a straight line passing a center point in height of the reinforcing rib and parallel to the upper surface of the substrate crosses a width of the reinforcing rib and a width of the rising portion of each hook in such a manner that a ratio of a line segment of the straight line crossing the width of the reinforcing rib to a line segment of the straight line crossing the width of the rising portion is ⅕ to ½.

Preferably, the reinforcing rib is rising perpendicularly and substantially centrally from the base of the rising portion and has a varying width progressively increasing from around the center in height toward the base of the rising portion. In an alternative form, the reinforcing rib may be rising perpendicularly and substantially centrally from the base and is curved from around the center in height toward the upper end with substantially the same width along the axis of the hook and has a varying width increasing progressively from around the center in height to the base.

In operation, comparing with the conventional hook structure with reinforcing ribs, the internal stress of the hook when load is exerted on the hook-shape engaging portion upwardly to deform the hook will be distributed within a wide range along both the rear-surface side and the front-surface side (hook side) of the rising portion. The stress will be diffused, causing no large local stress concentration. This means that even if load is exerted on the hooks repeatedly, any damage will be avoided to improve the durability. If the height of the reinforcing ribs is set to a value greater than the above-mentioned figure, the whole hook will become rigid and hence much less flexible.

If the reinforcing rib is located at a position very close to the rear-surface side or front-surface side of the hook with no change in the shape of the hook as well as in the shape and height of the reinforcing rib, a large stress will concentrate locally on the side toward which the reinforcing rib is positioned, compared to the hook structure of this invention. But compared to the conventional hook, less local concentration of stress will occur. It is therefore understood that how much it is important to select the position of the reinforcing rib.

DETAILED DESCRIPTION

Figure 3B:
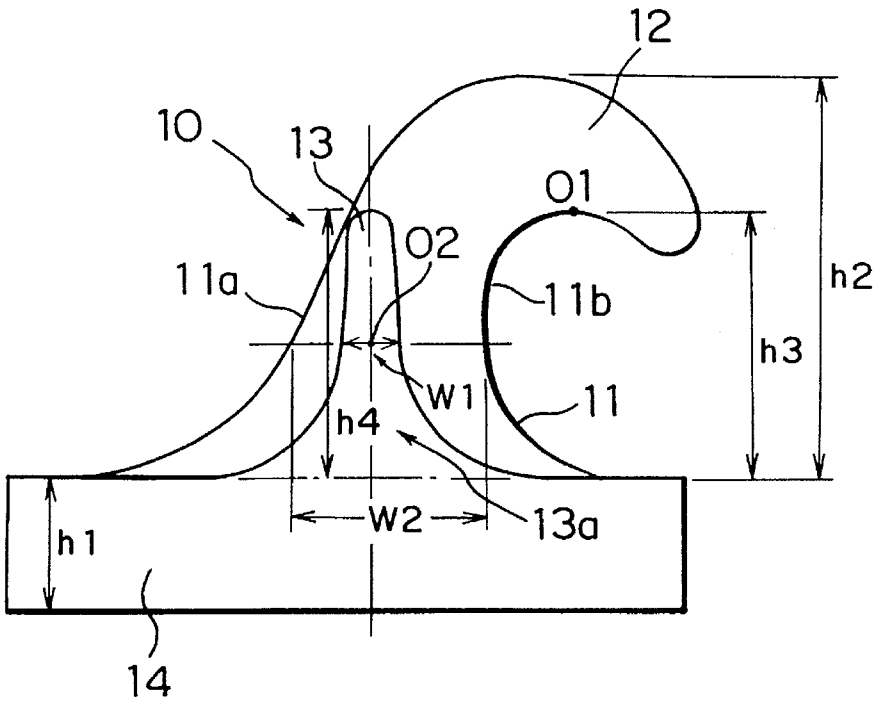
FIGS. 3(A) and 3(B) show a conventional hook structure as a first comparative example and the distribution of internal stress of the hook when deformed.
Figure 3A:
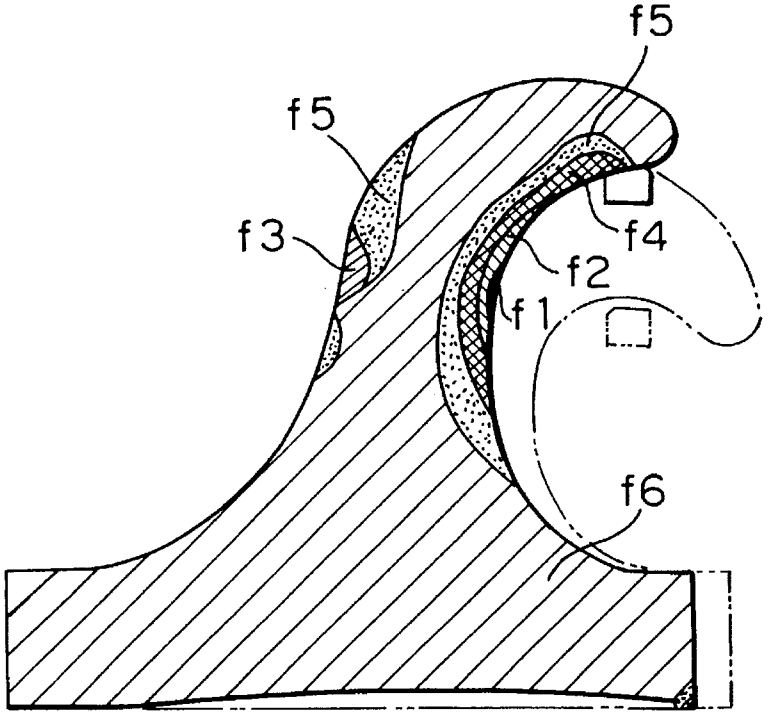
Figure 4B:
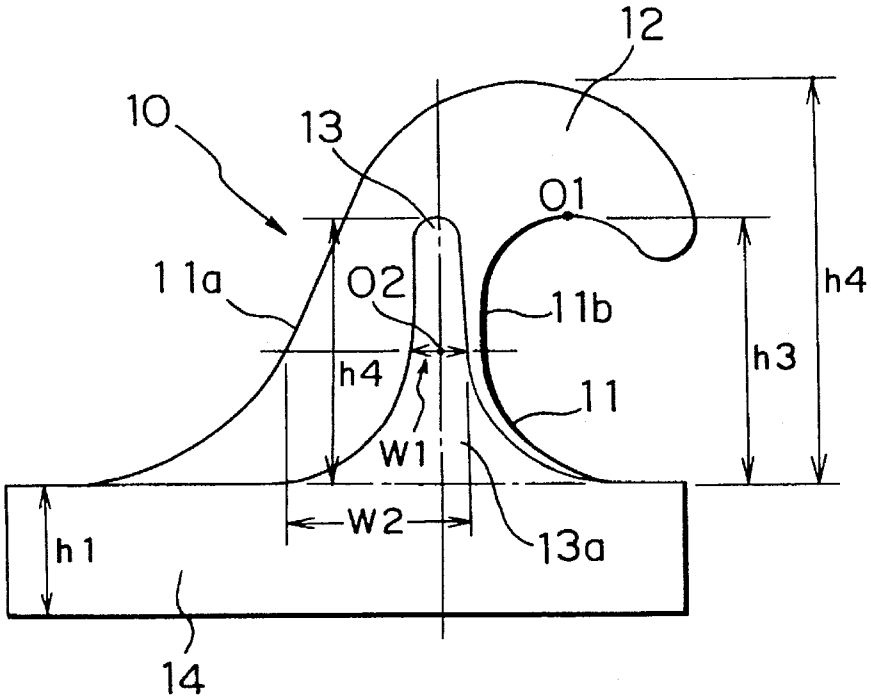
FIGS. 4(A) and 4(B) show another conventional hook structure as a second comparative example and the distribution of internal stress of the hook when deformed.
Figure 4A:
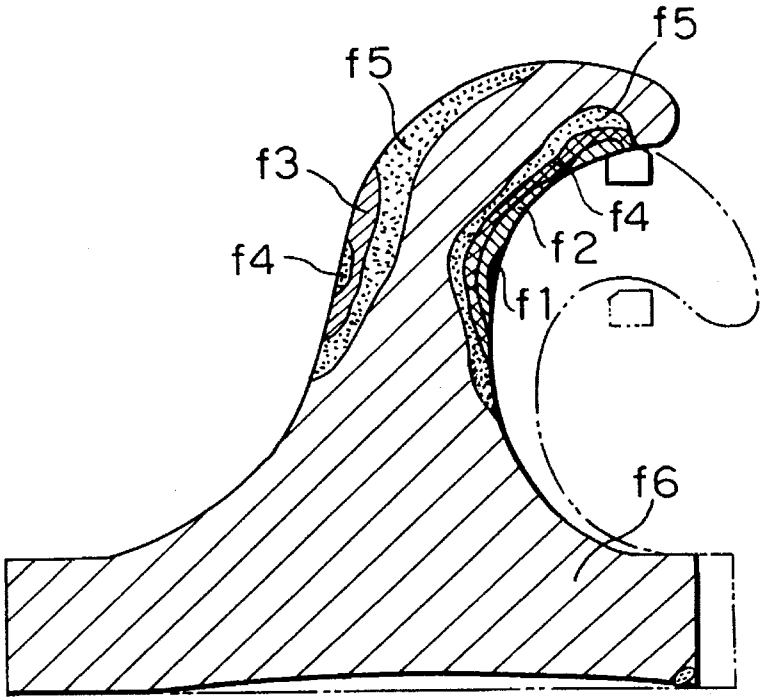
Figure 5B:
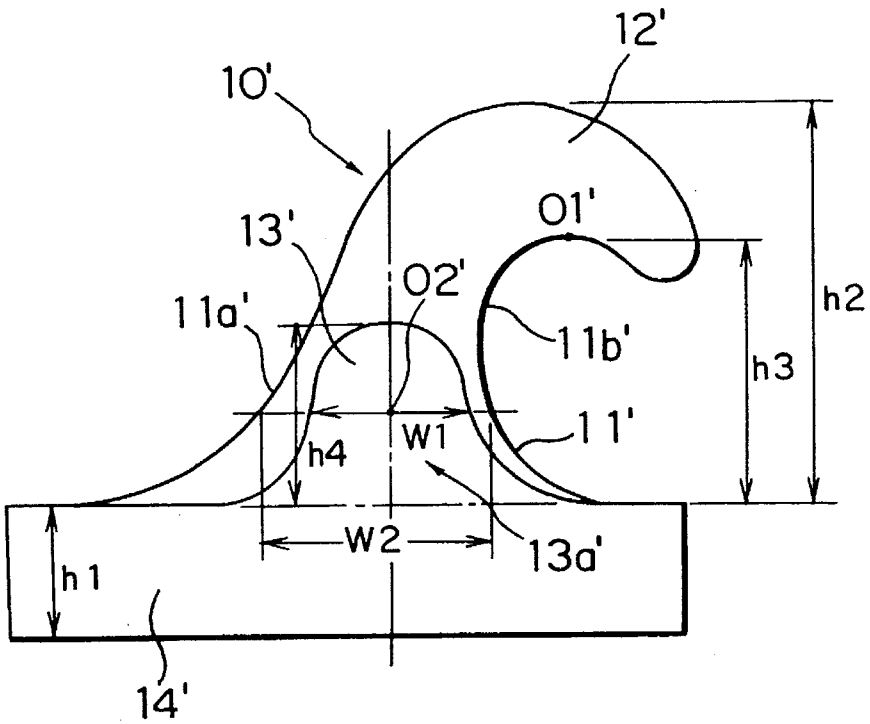
FIG. 5(B) (PRIOR ART)
FIGS. 5(A) and 5(B) show a hook structure now put into practice and the distribution of internal stress of the hook when deformed.
Figure 5A:
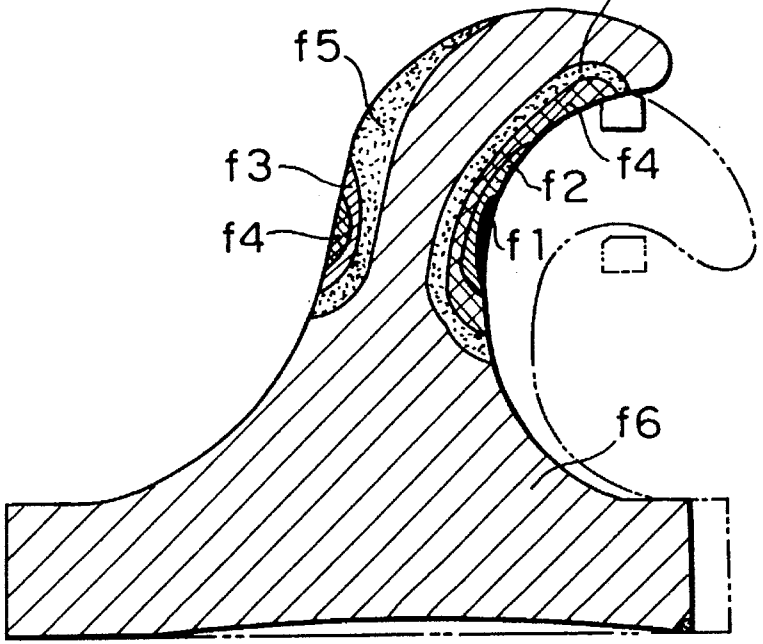
FIG. 5(A) (PRIOR ART)

Embodiments of this invention, together with comparative examples, will be described in detail with reference to the accompanying drawings. FIGS. 1(A), 1(B) and 2(A) 2(B) show surface fasteners having examples of typical hook structures of this invention and the distribution of internal stress in individual hooks and a substrate when load is exerted on a hook-shape engaging portion of the hook to deform the hook-shape engaging portion upwardly. FIGS. 3(B) and 4(A), 4(B) show hook structures as comparative examples. FIGS. 5(A), 5(B) shows the conventional hook structure and the distribution of internal stress in the hook when the hook-shape engaging portion is deformed.

In FIGS. 1(A) through 4(B), the hook 10 is composed of a rising portion 11, which has a rear surface 11*a* rising obliquely in a smooth curve from a substrate 14 and a front surface 11*b* rising upwardly, and a hook-shape engaging portion 12 extending forwardly from the upper end of the rising portion 11 and curving downwardly. The hook has a varying cross-sectional area increasing progressively from the distal end of the hook-shape engaging portion 12 toward the base of the rising portion 11. The rising portion 11 has on each of opposite side surfaces a reinforcing rib 13 having an arcuate upper surface and front and rear surfaces outwardly curving toward the base. This hook structure is identical with the structure of FIGS. 5(A), 5(B) in these respects.

In the hook structures of FIGS. 1(A), 1(B) and 2(A), 2(B) showing preferred embodiments of this invention, as is apparent from comparison with FIG. 5(B), the width of the upper portion of the reinforcing rib 13 except the base 13*a* is small, and the reinforcing rib 13 has a height about 1.5 times the height of the reinforcing rib 13' of FIG. 5(B). Further, the reinforcing rib 13 of this embodiment, unlike the reinforcing rib 13' of FIG. 5(B), is located substantially centrally on the base of the hook 10.

Figure 1B:
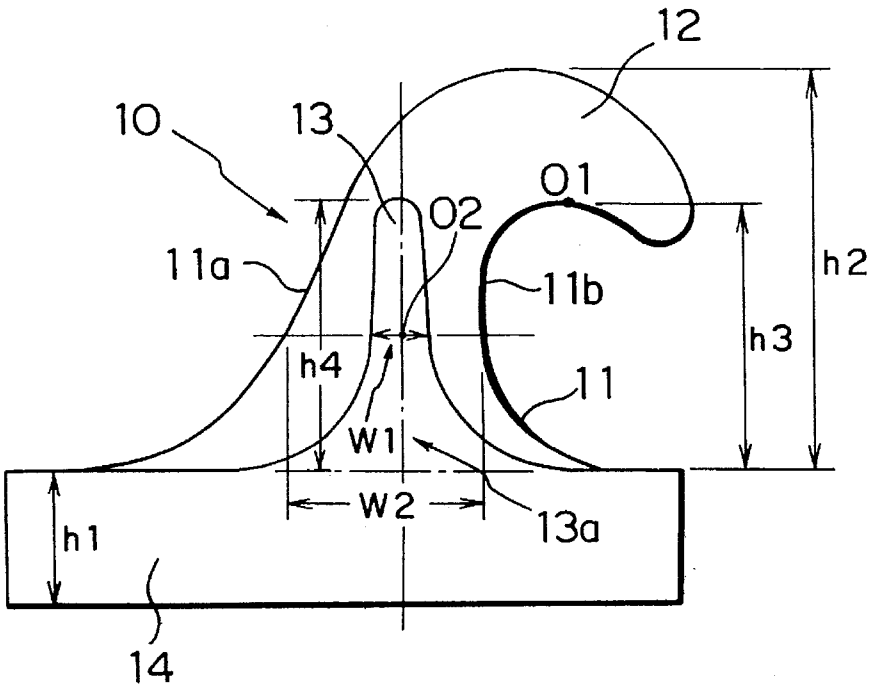
FIGS. 1(A) and 1(B) show a hook structure according to a typical embodiment of this invention and the distribution of internal stress of the hook when deformed.

This hook structure will now be described more in detail saying actual figures for size. But the hook 10 of this invention should by no means be limited to this actual size. In FIG. 1(B), the thickness h1 of the substrate 14 is 0.3 mm; the height h2 of the hook 10 above the surface of the substrate 14, 0.9 mm; and the height h3 from the surface of the substrate 14 to the peak $O_1$ of the lower surface of the curve of the hook-shape engaging portion 12, 0.6 mm. And the height of the reinforcing rib 13, likewise the height h3, is 0.6 mm, which constitutes a part of characteristic features of this invention. Whereas the height h4' of the conventional reinforcing rib 13' of FIG. 5 is 0.4 mm, i.e. only ⅔ of the height h4 of the reinforcing rib 13 of this invention.

With regard to the location, the reinforcing rib 13 of this invention is located substantially centrally of the rising portion 11 of the hook 10, while in the conventional hook 10' of FIG. 5(B) the reinforcing rib 13' is located toward the front surface (right in FIG. 5(B)) of the hook 10'. This will be understood by comparing the distance between the rear surface of the reinforcing rib 13 and the rear surface 11*a* of the hook 10 and the distance between the front surface of the rib 13 and the front surface 11*b* of the hook 10 in a horizontal plane passing the central point $O_2$ of the height h4 with the corresponding distances of the same positions in FIG. 5(B). The reason why the reinforcing rib 13 is located substantially centrally of the base of the hook 10 is that the shape of the hook 10 and the shape of the reinforcing rib 13 may vary in wide selection and the location of the reinforcing rib 13 cannot be limited numerically. But the location of the reinforcing rib 13 also is one of important factors of this invention.

In connection with the location of the reinforcing rib 13, another important factor of this invention is a relationship between the width w1 of the reinforcing rib 13 in a horizontal plane passing the central point $O_2$ of the reinforcing rib 13 and the width w2 of the hook 10 in a horizontal plane passing the central point $O_2$. Specifically, it is necessary that the ratio of the width w1 to the width w2 is within a range of ⅕ to ½. If the width ratio is less than ⅕, the rib would lose its essential reinforcing function. If the ratio exceeds ½, the whole hook would have become rigid as dominated by the rigidness of the rib.

Figure 2B:
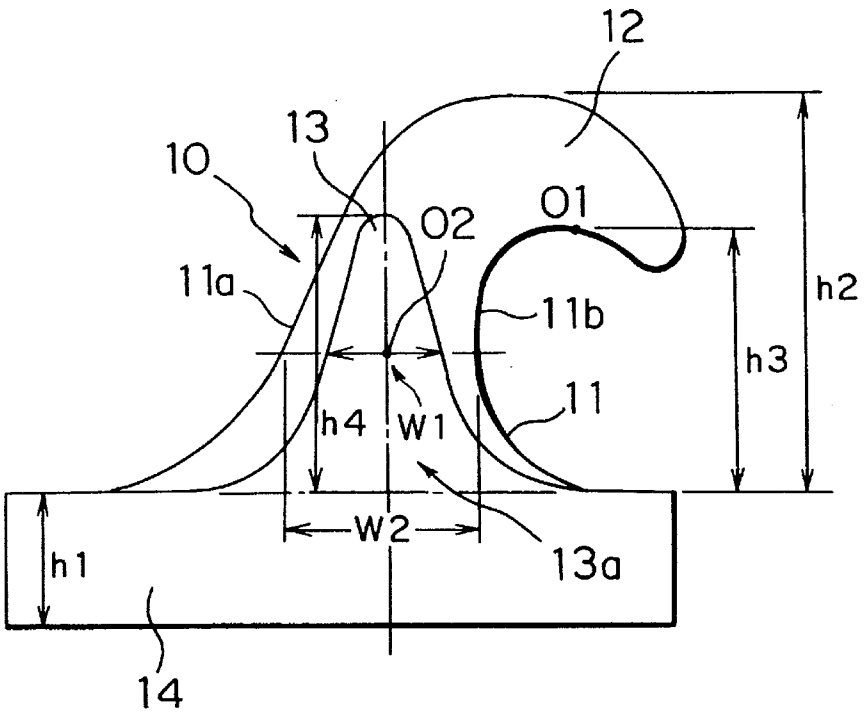
FIGS. 2(A) and 2(B) show a hook structure according to another embodiment of the invention and the distribution of internal stress of the hook when deformed.

FIGS. 1(B) and FIG. 2(B) show the hook structures of this invention in which the width ratios of the respective reinforcing ribs 13 are approximate to the lower and upper limit values. FIGS. 3(B) and 4(B) show the hook structures of comparative examples in which the width ratios of the reinforcing ribs 13 are less than ⅕. FIG. 5(B) shows a comparative example in which the width ratio exceeds ½. As is apparent from these drawings, the shape of the reinforcing ribs 13 of FIGS. 3(B) and 4(B) are identical with the shape of the reinforcing rib 13 of FIG. 1(B); however, in FIG. 3(B) the reinforcing rib 13 is located close to the rear surface of the hook 10, while in FIG. 4(B) it is located close to the front surface of the hook 10.

FIGS. 1(B), 2(B), 3(B), 4(B) and 5(B) show the substrate and the hook structure as viewed from the side. FIGS. 1(A), 2(A), 3(A), 4(A) and 5(A) illustrate the distribution of internal stresses which develop in the respective hook having the structure of each of FIGS. 1(B) through 5(B) when the hook-shape engaging portion of the respective hook is deformed upwardly under a predetermined load. In these drawings, reference numerals f1–f6 designate various regions of different stresses, the relationship between f1–f6 being f1>f2>f3>f4>f5>f6.

Figure 1A:
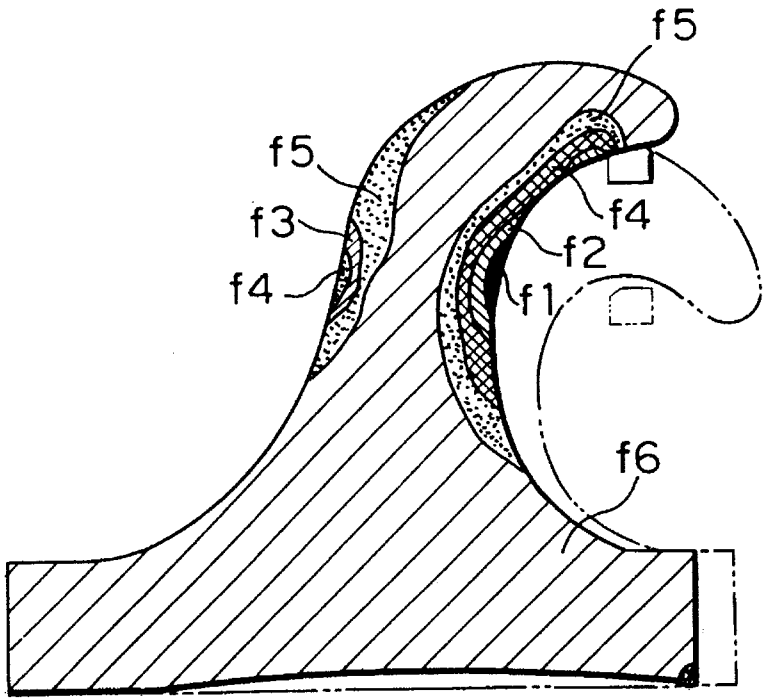
Figure 2A:
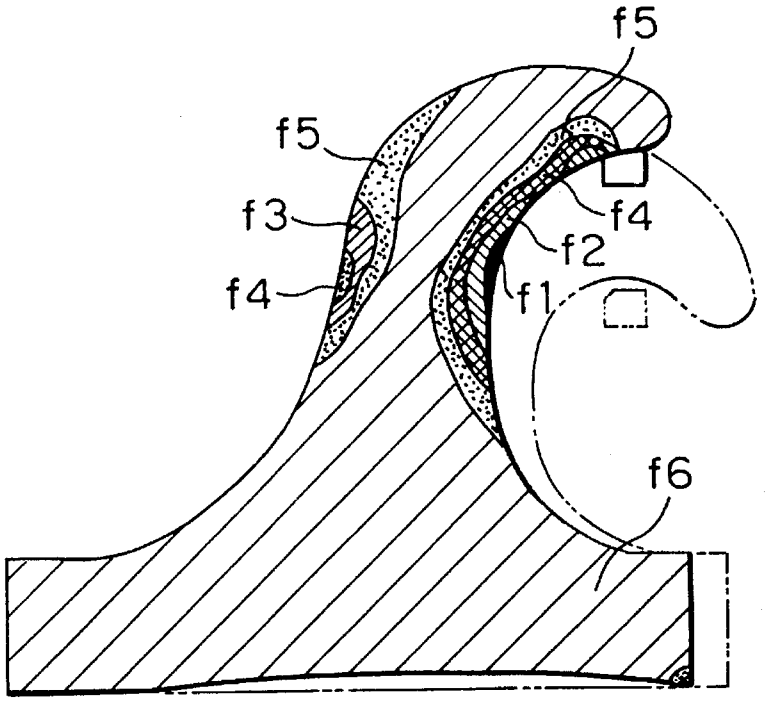

Comparing the stress distribution in the present hook structure of FIGS. 1(A) and 2(A) with that in the conventional hook structure of FIG. 5, the stress distribution of the present structure at either the rear-surface-side or the front-surface side (the hook side) of the hook extends toward the base more than the stress distribution of the conventional structure; apparently, stress is distributed over a wide range, and no great stress concentrates locally as it disperses. This means that even if load is exerted on the hooks repeatedly, any damage will be avoided to improve the durability. Though not shown in the drawings, if the height h4 of the reinforcing ribs 13 is set to a value greater than the above-mentioned figure, the whole hook will become rigid and hence much less flexible.

In the comparative examples of FIGS. 3(B) and 4(B), the shape and the height h4 of the reinforcing rib 13 are identical with those of the embodiment of FIG. 1(B), but the location of the reinforcing rib 13 is very close to the rear surface or the front surface (hook side) of the hook 10. As is apparent from FIGS. 3(B) and 4(B), since the structure of the reinforcing rib 13 is identical with the embodiment of FIGS. 1(A), 1(B) less local stress concentration will occur compared to the conventional hook 10' of FIGS. 5(A), 5(B), and local stress concentration is larger at the side toward the reinforcing rib 13 is located, compared to the embodiment of FIGS. 1(A), 1(B). It is accordingly understood that how much it is important to select the location of the reinforcing rib 13.

Figure 6:
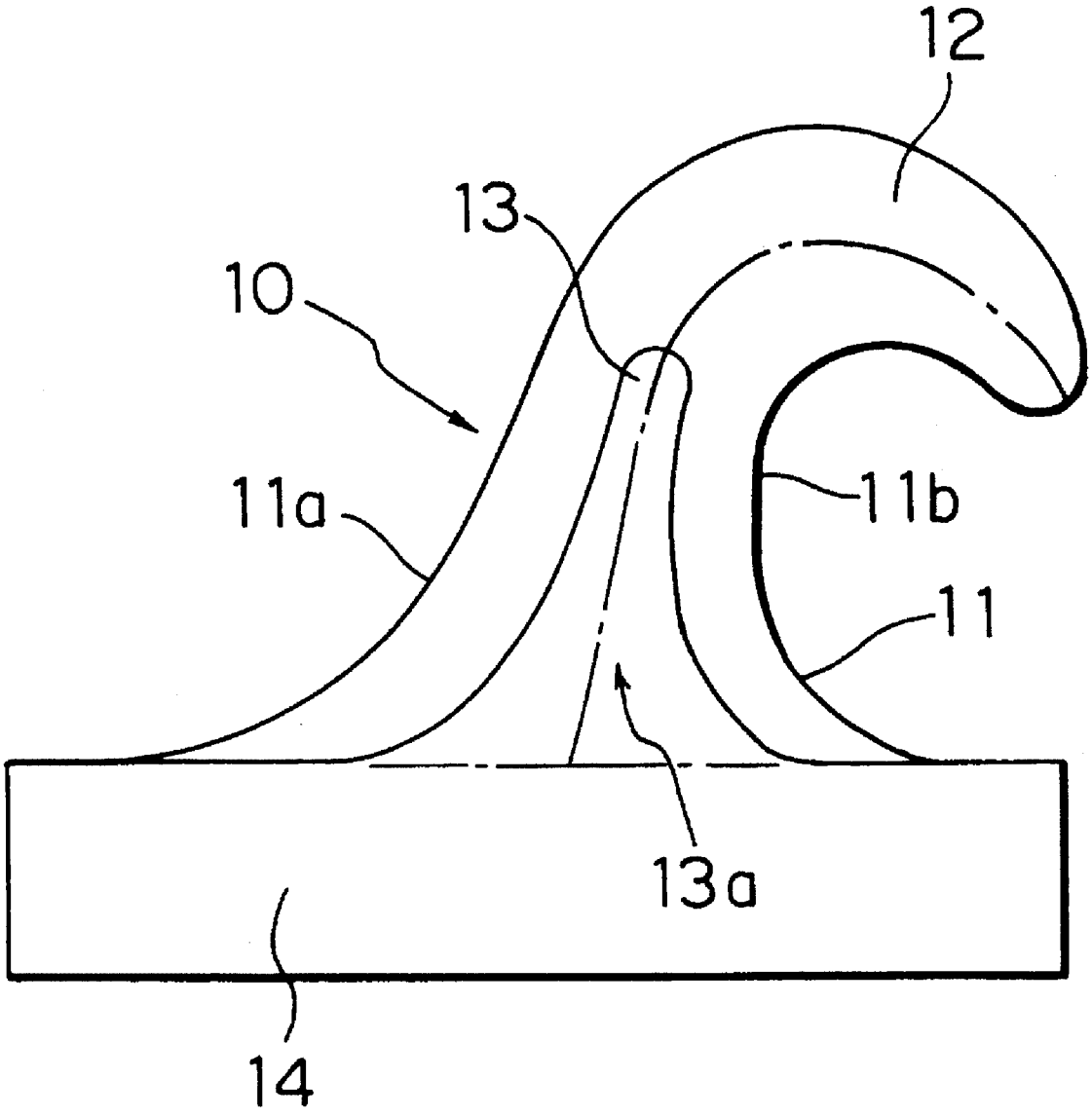
FIG. 6 shows a hook structure according to still another embodiment of the invention.

FIG. 6 is a side view showing a hook structure according to another embodiment of this invention. The embodiment of FIG. 6 is similar to the embodiment of FIG. 1 except that the upper end portion of the reinforcing rib 13 is slightly curved along the shape of the hook. And the upper portion of the reinforcing rib 13 has a width smaller than that of the base 13*a*, and the rib height h4 is equal to the rib height of FIG. 1(B). Further, the upper portion of the reinforcing rib 13 of this embodiment is curved along the center line of the hook 10, as is apparent from FIG. 6.

According to the molded hook structure of this invention, as described above in detail, by defining parameters, e.g. the height, location and width, of the reinforcing rib projecting from the side surface of the hook specifically, it is possible to improve the engaging rate of the hooks with loops of the companion fastener member as combined with the unique hook structure. With this arrangement, the loops of the companion fastener member can be released smoothly during the peeling, so no large local stress concentration will occur as the stress due any instant resistance disperses over a wide range, thus keeping the engaging portion free from damages. More particularly, the molded surface fastener is adequately durable against repeated use as the hooks are not so rigid during the engaging and peeling, thus securing a smooth touch like the woven-type surface fastener. In addition, since the reinforcing ribs prevent the hooks from falling flat and secure adequate toughness, it is possible to reduce the thickness of the hook so that the density of hooks can be increased. Therefore this molded surface fastener has adequate durability in repeated use and is excellent in flexibility, approximating to the woven-type surface fastener.

What is claimed:

1. A hook structure for a molded surface fastener having a multiplicity of hooks molded integrally on an upper surface of a plate-like substrate;

wherein each of said hooks has a rising portion and a hook-shape engaging portion extending forwardly from an upper end of said rising portion, said rising portion having a rear surface rising obliquely in a smooth curve from said substrate, a front surface rising upwardly from said substrate, and side surfaces from at least one of which a reinforcing rib extends;

wherein a straight line drawn between a peak of said reinforcing rib and a peak of an arcuate, concave lower surface of said hook-shape engaging portion is substantially parallel to the upper surface of said plate-like substrate;

wherein the reinforcing rib is rising upwardly and substantially centrally from a side surface of said rising portion of each of said hooks; and wherein a straight line passing a center point in height of the reinforcing rib and parallel to the upper surface of the substrate crosses a width of the reinforcing rib and a width of the rising portion of each of said hooks in such a manner that a ratio of the width of the reinforcing rib to the width of the rising portion is ⅕ to ½.

2. A hook structure according to claim 1, wherein said reinforcing rib is rising perpendicularly and substantially centrally from the base of said rising portion and has a varying width progressively increasing from around the center in height toward the base of said rising portion.

3. A hook structure according to claim 2, wherein said reinforcing rib is rising perpendicularly and substantially centrally from the base, is curved from around the center in height toward the upper end with substantially the same width along the axis of the hook and has a varying width increasing progressively from around the center in height to the base.

4. A hook structure according to claim 1, wherein said reinforcing rib is profiled from around the center in height toward the upper end with substantially the same width along the axis of the hook and has a varying width increasing progressively from around the center in height to the base.

5. In a hook structure for a molded surface fastener having a multiplicity of hooks molded integrally on an upper surface of a plate-like substrate; wherein each of said hooks has a rising portion and a hook-shape engaging portion extending forwardly from an upper end of said rising portion, said rising portion having a rear surface rising obliquely in a smooth curve from said substrate, a front surface rising upwardly from said substrate, and side surfaces from at least one of which a reinforcing rib extends, the improvement comprising:

said hook and reinforcing rib shaped such that a straight line between a peak of said reinforcing rib and a peak of an arcuate, concave lower surface of said hook-shape engaging portion is substantially parallel to the upper surface of said plate-like substrate;

the reinforcing rib is rising upwardly and substantially centrally from a side surface of said rising portion of each of said hooks; and a straight line passing a center point in height of the reinforcing rib and parallel to the upper surface of the substrate crosses a width of the reinforcing rib and a width of the rising portion of each of said hooks in such a manner that a ratio of the width of the reinforcing rib to the width of the rising portion is ⅕ to ½.

6. The improvement according to claim 5, wherein said reinforcing rib is rising perpendicularly and substantially centrally from the base of said rising portion and has a varying width progressively increasing from around the center in height toward the base of said rising portion.

7. The improvement according to claim 5, wherein said reinforcing rib is profiled from around the center point in height toward the upper end with substantially the same width along the axis of the hook and has a varying width increasing progressively from around the center in height to the base.

* * * * *